United States Patent [19]

Mitchell et al.

[11] 4,324,087

[45] Apr. 13, 1982

[54] GARMENT BAGGING SYSTEM

[75] Inventors: William O. Mitchell; Gordon H. Ellington, both of Vidalia, Ga.

[73] Assignee: Oxford Industries, Inc., Atlanta, Ga.

[21] Appl. No.: 135,104

[22] Filed: Mar. 28, 1980

[51] Int. Cl.[3] ..... B65B 25/20

[52] U.S. Cl. ..... 53/241; 53/256

[58] Field of Search ..... 53/241, 256, 469, 459, 53/567, 576

[56] References Cited

U.S. PATENT DOCUMENTS

| | | | |
|---|---|---|---|
| 3,287,881 | 11/1966 | Jelling et al. | 53/256 |
| 3,360,901 | 1/1968 | Gallo | 53/390 |
| 3,760,558 | 9/1973 | Kaminsky et al. | 53/183 |
| 3,895,480 | 7/1975 | Lombardo | 53/241 X |
| 3,961,460 | 6/1976 | Jelling et al. | 53/241 X |
| 3,982,377 | 9/1976 | Vanderpool | 53/241 X |
| 4,094,128 | 6/1978 | Vulcano et al. | 53/241 X |
| 4,100,719 | 7/1978 | Jelling et al. | 53/241 |
| 4,169,345 | 10/1979 | Douwenga | 53/570 |
| 4,233,797 | 11/1980 | Schwarz | 53/241 |

*Primary Examiner*—James F. Coan

*Attorney, Agent, or Firm*—Jones & Askew

[57] ABSTRACT

Tubular bag material is threaded downwardly between spaced support members. A garment support assembly is inserted into the tubular bag material at a level below the support members and then moved upwardly between the support members and rests on the support members. A garment is hung from the hook at the lower end of a downwardly projecting support rod extending from the garment support assembly and the tubular bag material is pulled downwardly by an operator about the garment. A bag cutting and sealing means moves into contact with the tubular bag material about the support rod to form the upper end of the bag about the garment and to cut the formed bag away from the tubular bag material. The operator then pulls the formed bag away from the tubular bag material down onto the garment.

11 Claims, 8 Drawing Figures

GARMENT BAGGING SYSTEM

BACKGROUND OF THE INVENTION

This invention relates to a method and apparatus for forming a bag about garments and the like, particularly to a system for moving open ended tubular bag material from a supply downwardly about a garment suspended from a hanger and then closing the upper portion of the tubular bag material that extends about the garment and cutting the closed bag away from the supply of tubular bag material.

Various bagging systems have been developed for the purpose of forming bags or envelopes about garments and other products, wherein tubular material is moved along its length to envelope the product and the tubular material is closed at one or both ends of the garment to form a bag or envelope about the garment. The prior art devices which separates the sides of the tubular bag material and supports a garment or the like as the tubular bag material is moved about the garment. For example, it is known in the prior art to support a bag opener device on a pair of spaced support members and pull the tubular bag material between the spaced support members and about the bag opening device.

One of the problems encountered in the prior art bagging system is the threading of the tubular bag material through the system when the bag material needs to be changed. For example, the bag opening device usually must be removed from the apparatus, the bag opener inserted into the new supply of tubular bag material, then the tubular bag material inserted through the remaining portion of the apparatus, and finally the bag opener device re-inserted in the assembly. This procedure usually is cumbersome and time consuming, sometimes requiring the skills of an experienced operator. In those instances where the tubular bag material must be changed on a frequent bases, as when some bag material includes a certain trademark or other printed information which is to be applied to some garments while other bag materials include different trademarks, etc. which are to be applied to other garments, the time and effort required to change the bag material tends to prohibit the change of the material, so that the manufacturer does not have a practical choice of appropriate trademarks or other printed information on the bags formed about the garments.

SUMMARY OF THE INVENTION

Briefly described, a present invention comprises a garment bagging system wherein a plurality of reels of tubular bag material are supported by a framework in a ready situation, and the free end of one of the reels of tubular bag material is threaded upwardly over a guide, then downwardly between spaced support members past bag cutting and sealing means to an operator's level therebelow. A garment support insert having an enlarged upper portion is threaded into the lower open end of the tubular bag material and moved upwardly until its enlarged upper portion passes between the spaced support members, and then the enlarged portion becomes supported by the spaced support members. A garment support rod extends downwardly from the garment support assembly, and a worker hangs a garment on the lower end of the garment support rod and pulls the tubular material downwardly about the garment. The worker causes the cutting and sealing means to move into contact with the bag material on opposite sides of the garment support rod to seal the bag material over the garment and to cut the formed bag away from the supply of tubular bag material. The worker then pulls the formed bag downwardly away from the tubular bag material until the upper closed end of the formed bag engages the garment.

The garment support assembly is resiliently held in position above the operator's station, and when it is desirable to substitute one tubular bag material for another, the operator simply grasps the garment support assembly and pulls downwardly, causing the garment support assembly to be released from the supporting framework. The worker then causes the supply of tubular bag material that was formerly being used to be reeled back on its reel, and the worker then threads the free end of another tubular bag material from a different reel into the bagging system.

The supporting framework includes means for aligning the bag support assembly so that its garment support rod is always centrally located between the two halves of the cutting blade and the two halves of the heated sealing assembly, thereby causing the bag material to be cut and sealed from its opposite side edges inwardly toward the garment support rod, leaving the formed bag attached only at its upper central portion to the supply of tubular bag material, and forming a passageway between the formed bag and the supply of tubular bag material, whereupon the operator can tug downwardly on the formed bag to tear the formed bag away from the free end of the supply of tubular bag material, with the unsealed portion or passageway at the upper end of the formed bag passing about the upper hook of a coat hanger which supports the garment.

Thus, it is an object of this invention to provide a garment bagging system which is inexpensive to construct and to operate and which enables an unskilled operator to expediently change the tubular bag material.

Another object of this invention is to provide a bagging system for forming bags about garments or the like, which can be safely or expediently operated by an unskilled operator, which, with a minimum amount of operator skill, functions to form bags at a proper length with respect to garment of variable size and shape.

Other objects, features and advantages of the present invention will become apparent upon reading the following specification, when taken in conjunction with the accompanying drawings.

DETAILED DESCRIPTION

Figure 1:
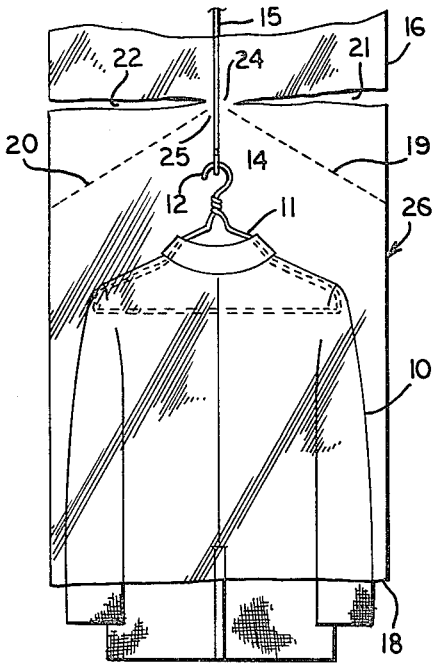
FIGS. 1 and 2 are progressive schematic front elevational views of a garment on a hanger, with the hanger suspended from a garment support rod, showing progressively how the tubular bag material is first sealed and cut to form a bag, and how the formed bag is moved downwardly about the garment.
Figure 2:
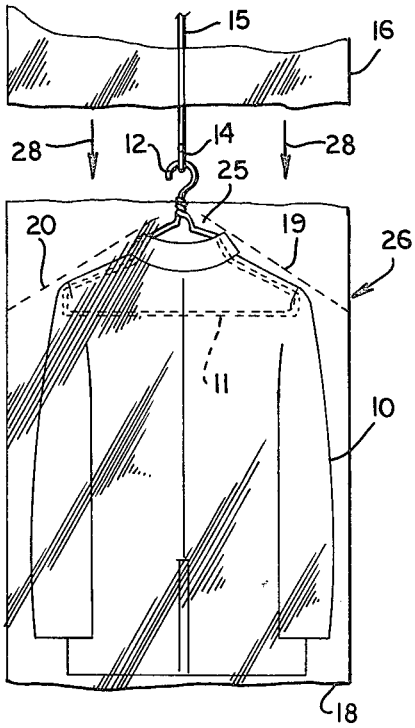

Referring now in more detail to the drawing, in which like numerals indicate like parts throughout several views, FIGS. 1 and 2 schematically illustrate the process which the system operator uses for forming a bag about a garment or the like. A garment such as shirt 10 is suspended upon a conventional coat hanger 11, and the hook 12 of the coat hanger is suspended on the hook 14 at the lower end of a garment support rod 15. Tubular bag material 16 is pulled downwardly by the operator about garment support rod 15 and garment 10 until the lower edge 18 of the tubular bag material is located just above the lower portion of the garment 10. The operator then removes her hands from the tubular bag material and actuates hand switches at opposite sides of the equipment (disclosed later in more detail), causing seals 19 and 20 to be made from the side edges of the bag material inwardly toward garment support rod 15, and causing cuts 21 and 22 to be made inwardly from the side edges of the bag material toward the garment support rod, above the sealed areas 19 and 20. Thus, the cuts 21 and 22 extend approximately perpendicular to the length of the tubular bag material, leaving a small connection at 24 about garment support rod 15, and the seals 19 and 20 form an approximately inverted V-shaped seal with a passage or opening 25 between the seal lines 19 and 20 about garment support rod 15.

After the seal and cut have been made in the tubular bag material as illustrated in FIG. 1, the operator then tugs downwardly at the opposite edges of the formed bag 26, causing the small connection 24 between the formed bag and the tubular bag material 16 to break, and causing the formed bag 26 to move downwardly as indicated by arrows 28. The passage 25 between the seal lines 19 and 20 moves downwardly about the hooks 12 and 14 until the seal lines 19 and 20 engage the upper portion of the garment 10. The lower edge 18 of the formed bag thus moves downwardly until it is below the lower edge of the garment 10. The operator then removes the bagged garment and its coat hanger from the garment support rod 15 and places another unbagged garment and coat hanger on the rod.

The tubular bag material 16 can be fabricated from substantially any thermoplastic sheet material, such as conventional polyethelene or polypropolene material. The composition of the bag material will be determined by, for example, the amount of protection desired for the garment, the expense of the tubular bag material, and the ability of the material to be properly fused and cut by the garment bagging system.

Figure 3:
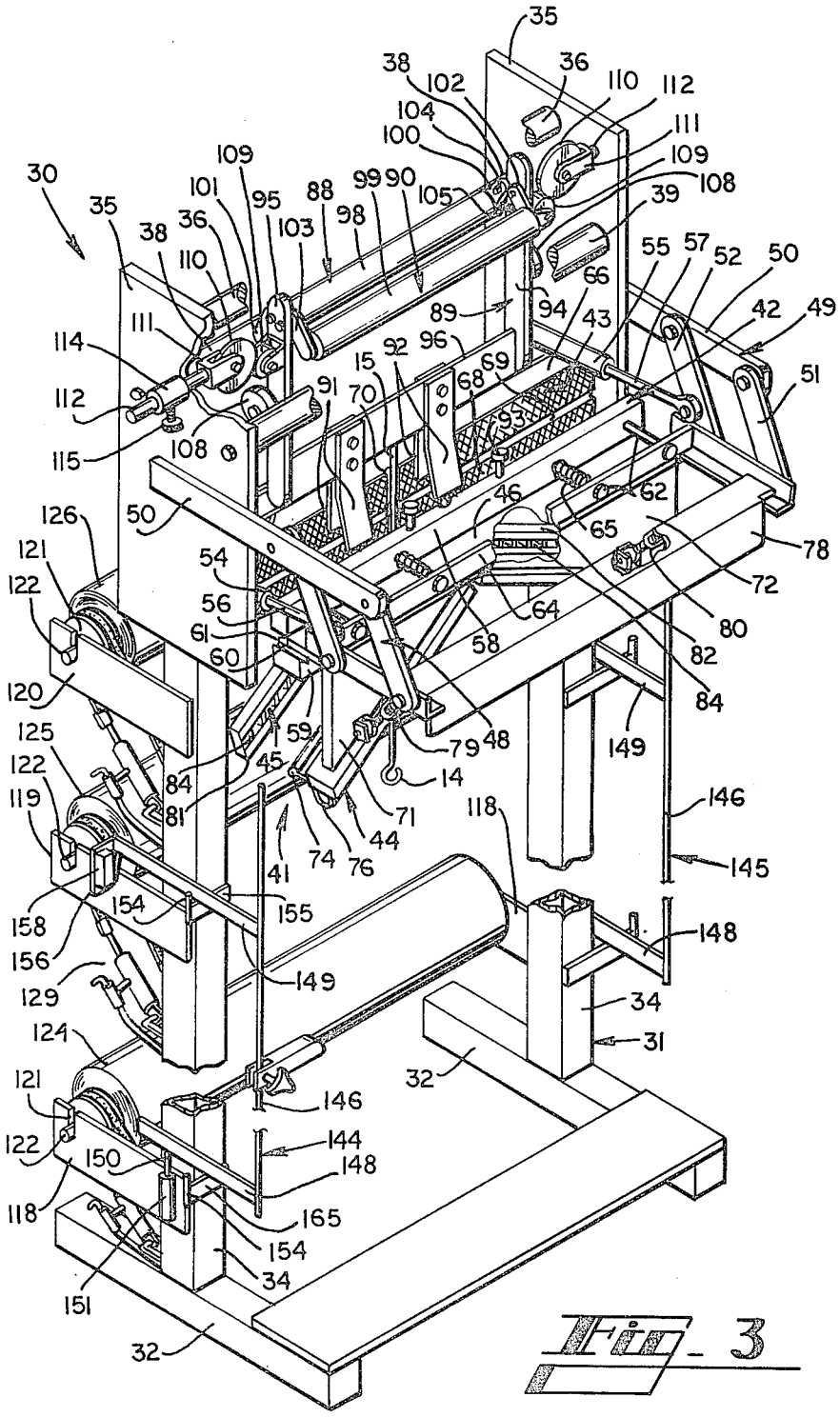
FIG. 3 is a perspective illustration of the garment bagger.

As illustrated in FIG. 3, the garment bagging system 30 comprises a support frame 31 with spaced apart support feet 32 and spaced upright support stanchions 34. Upper side plates 35 are supported at the upper portions of stantions, 34 and various cross bracing (not illustrated) is used to stabilize the support frame. Upper guide bar 36 and spaced support bars 38 and 39 are parallel to one another and oriented in horizontal attitudes and are each supported at their ends by upper side plates 35. Support bars 38 and 39 are located below upper guide bar 36 and define a space 40 therebetween.

Cutting and sealing means 41 is located at a level below support bars 38 and 39 and include cutter assembly 42, cutter receiver assembly 43, sealer assembly 44 and sealer receiver assembly 45. Cutter assembly 42 and sealer assembly 44 are mounted on horizontally extending support plate 46, and support plate 46 is mounted at each of its ends on parallel linkages 48 and 49. Each parallel linkage 48, 49 includes an upper support link 50 mounted at one of its ends to an upper side plate 35, and downwardly extending parallel links 51 and 52 are pivotably connected at their upper ends to the distal end of upper support link 50. The lower ends of the downwardly extending parallel links 51 and 52 are connected to a framework extension of horizontally extending support plate 46. Thus, support plate 46 is always maintained in a substantially horizontal attitude as shown. Fluid actuated cylinders 54 and 55 are mounted to the inside facing surfaces of upper side plates 35, and the cylinder rods 56 and 57 are connected to the downwardly extending parallel links 52 of each parallel linkage 48 and 49. Thus, cylinders 54 and 55 function to swing horizontally extending support plate 46 back and forth in an arc toward and away from cutter receiver assembly 43 and sealer receiver assembly 45.

Figure 5:
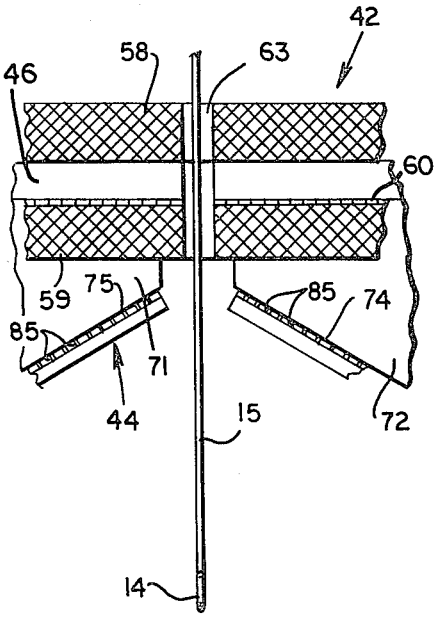
FIG. 5 is a detail illustration of the cutting and sealing means.
Figure 7:
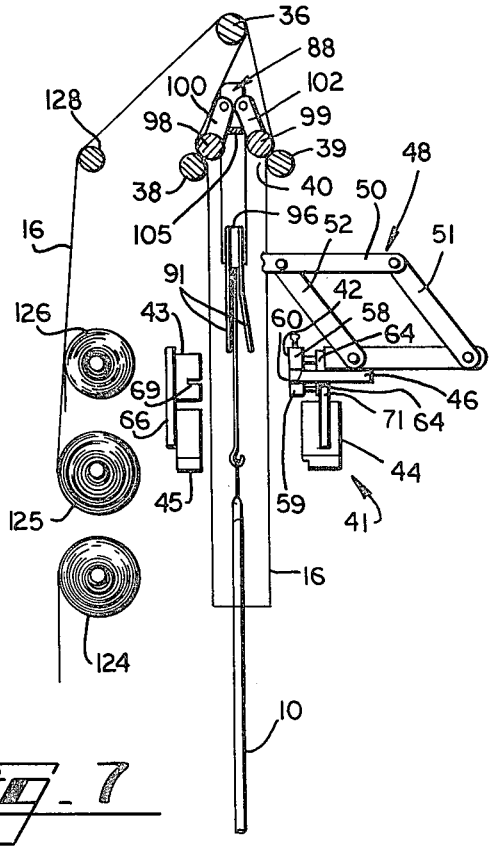
FIG. 7 is a schematic side elevational view of the garment bagging system.

As illustrated in FIG. 5, cutter assembly 42 includes upper and lower gripper blocks 58 and 59 positioned on opposite sides of the horizontally extending support plate 46 and cutting blade 60 attached to the horizontally extending support plate 46. The cutting edge 61 of cutting blade 60 is serrated. As illustrated in FIG. 3, the upper and lower gripper blocks 58 and 59 are each moveably mounted on horizontally extending support plate 46, as by pins 62 extending from the rear faces of each gripper block 58 and 59 and extending through an opening in the upwardly projecting flange of an angle iron 64 mounted to the upper and lower surfaces of the horizontally extending support plate 46. Coil compression springs 65 are mounted about some of the pins 62 so as to bias the gripper blocks 58 and 59 slightly beyond the serrated cutting edge 61 of cutting blade 60. A vertically extending rod receiving slot 63 (FIG. 5) is formed in the gripping face of gripper blocks 58 and 59, and cutting blade 60 is formed in two sections which straddle garment support rod 15.

Figure 4:
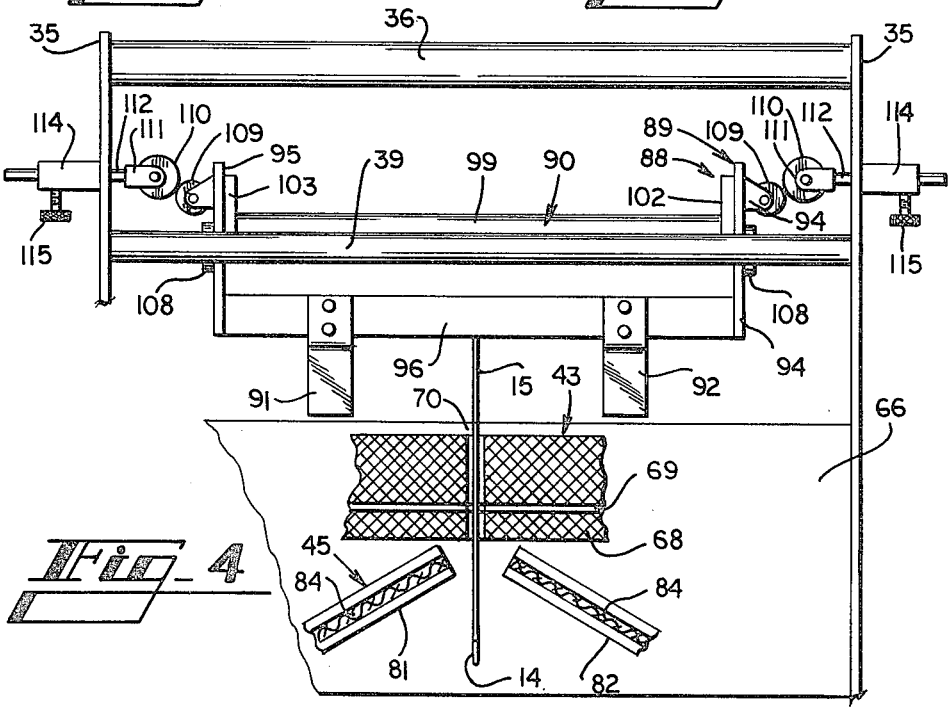
FIG. 4 is a partial front elevational view of the garment support assembly.

As illustrated in FIGS. 3 and 4, cutter receiver assembly 43 is mounted on vertically extending support plate 66 and includes an elongated, horizontally extending gripper face plate 68 which defines a horizontal cutter blade receiving slot 69 therein and a vertically extending garment support rod receiving slot 70.

The faces of gripper blocks 58 and 59 and the face of gripper face plate 68 have layers of corrugated rubber or other high friction material lamanated thereto for the purpose of gripping the tubular bag material 16 when the cutter assembly 42 moves toward contact with cutter receiver assembly 43.

As illustrated in FIGS. 3 and 5, sealer assembly 44 is mounted to the lower surface of horizontally extending support plate 46 by means of vertically extending wedge shaped support plates 71 and 72, and elongated heated elements 74 and 75 are supported at the lower edges of the surfaces of the wedge shaped support plates 71 and 72. The electrical connections for the elongated heated elements 74 and 75 are confined in asbestos shield 76 (FIG. 3) to protect the operator standing below the sealer assembly. The heated elements 74 and 75 are arranged in downwardly sloped attitudes from the central portion of the assembly, on opposite sides of garment support rod 15, and located vertically beneath cutting blade 60. A back brace 78 extends between the parallel linkages 48 and 49, and adjustable turn-buckle assemblies 79 and 80 are connected between the back brace 78 and the wedge shaped support plates 71 and 72 so that the elongated heated elements 74 and 75 are located precisely below cutting blade 60.

As illustrated in FIGS. 3 and 4, sealer receiver assembly 45 comprises a pair of elongated bars 81 and 82 rigidly mounted to support plate 66 beneath cutter receiver assembly 43. Each bar 81 and 82 is sloped downwardly from garment support rod 15 at angles corresponding to the slope of elongated heated elements 74 and 75. A strip of heat insulation material 84 is mounted in a slot formed in each bar 81 and 82 at a level corresponding to the level of the elongated heated element 74 and 75, so that when the heated elements are moved into engagement with the sealer receiver assembly 45, the heated elements engage the insulation material 84.

With the foregoing description it will be understood that the cutter assembly 42 and sealer assembly 44 move in unison toward engagement with their respective cutter receiver assembly 43 and sealer receiver assembly 45. The vertical slots 63 and 70 formed in the cutter assembly 42 and in the cutter receiver assembly 43, respectively, surround garment support rod 15 while the high friction surfaces of the cutter assembly and cutter receiver assembly move toward engagement with each other, thus securely trapping the tubular bag material therebetween. Since the gripper blocks 58 and 59 are moveable against the bias of their springs 65, cutting blade 60 will move through the bag material into the cutter blade receiving slot 69, thereby cutting through the bag material. In the meantime, the elongated heated elements 74 and 75 of the sealer assembly 44 move toward engagement with the heat installation material 84 of the sealer receiver assembly 45, thus heating and fusing the thermoplastic tubular bag material below the level where the bag material is cut. It will be noted that the elongated heated elements 74 and 75 define a series of slots or gaps 85 therein (FIG. 5), so that the seal lines 19 and 20 formed in the tubular bag material (FIGS. 1 and 2) comprises a series of spots of fused bag material with intervening areas of bag material that is not fused.

As illustrated in FIG. 4, garment support assembly 88 comprises bag opening frame 89, enlarged upper portion 90 and bag opener elements 91 and 92. Bag opening frame 89 includes vertically extending side braces 94 and 95, lower horizontal brace 96 connection at its ends to the side braces 94 and 95, and bag opener elements 91 and 92 comprise pairs of leaf springs each attached at their upper end portions to the horizontal lower brace 96 and extending downwardly therefrom on opposite sides of the garment support rod 15. Garment support rod 15 is connected at its upper end to horizontal brace 96 and extends downwardly therefrom and terminates at its lower end in hook 14.

Pins 93 protrude from the upper surface of upper gripper block 58 and move toward engagement with the bag opener elements 91 and 92 when the cutter assembly 42 and sealer assembly 44 move toward engagement with their cutter receiver assembly 43 and sealer receiver assembly 45. Thus, the pairs of leaf spring bag opener elements 91 and 92 are pressed flat together within the confines of the tubular bag material 16 during the cutting and sealing step. As soon as the cutter assembly and sealer assembly withdraw from the tubular bag material, the bag opener elements 91 and 92 tend to spread open the lower cut edge portion of the tubular bag material 16.

In the embodiment illustrated, the enlarged upper portion 90 of the bag opening frame 89 comprises a pair of parallel, horizontally extending rollers 98 and 99 each supported at their ends by levers 100, 101, 102 and 103. The levers 100–103 are each pivotably connected at their upper ends by pivot pins 104 to the upper end portions of vertically extending side braces 94 and 95. Coil compression springs 105 are positioned between levers 100 and 102 and 101 and 103 so as to bias the levers and their rollers apart. The breath of the rollers when biased apart by springs 105 is larger than the space 40 between support bars 38 and 39, so that when the rollers 98 and 99 are above the support bars 38 and 39, the rollers support themselves and garment support assembly 88 in the position illustrated. However, the breath of the rollers 98 and 99 when pressed together against the bias of their springs 105 is less than the space 40 between the support bars 38 and 39, so that the rollers can move from above the support bars 38 and 39 downwardly between the support bars and between the cutter and sealer assemblies 42 and 44 and their respective cutter receiver and sealer receiver assemblies of 43 and 45.

As illustrated in FIGS. 3 and 4, an alignment roller 108 is mounted on the outwardly facing surface of each vertically extending side brace 94 and 95 of the bag opening frame 89, and the diameter of the rollers 108 is slightly less than the space between support bars 38 and 39 but is more than the width of the vertically extending side braces 94 and 95. The alignment rollers 108 are positioned at the level of the support bars 38 and 39 when the bag opening frame 89 is supported by the support bars 38 and 39. Thus, the alignment rollers 108 function to maintain bag opening frame 89 in a vertical orientation when suspended from the support bars 38 and 39 and to keep the bag opening frame out of contact with the support bars 38 and 39.

Centering rollers 109 are also mounted on the outwardly facing surfaces of vertically extending side braces 94 and 95 of bag opening frame 89. Guide rollers 110 are mounted on each upper side plate 35 and extend inwardly thereof. The guide rollers include a bracket 111 and a stem 112 which extends from the bracket through an opening in the side plate 35, and a socket 114 extends from the outside surface of each side plate 35 about the opening and surrounds the stem 112. A set screw 115 is threaded into the side of socket 114 to engage the stem and to lock the guide rollers 110 in place. With this arrangement, the guide rollers 110 engage the centering rollers 109 to cause the garment support assembly 88 to be properly centered within the framework, causing garment support rod 15 to be properly positioned within its vertical rod receiving slots 63 and 70. Thus, when an operator moves the garment support assembly 88 in an upward direction so that its enlarged upper portion 90 moves between the support bars 38 and 39, the guide rollers 110 will require the bag opening frame 89 to be centered between the sides of the framework and the alignment rollers 108 will assure that the bag opening frame is vertically oriented and out of contact with the support bars 38 and 39.

Figure 6:
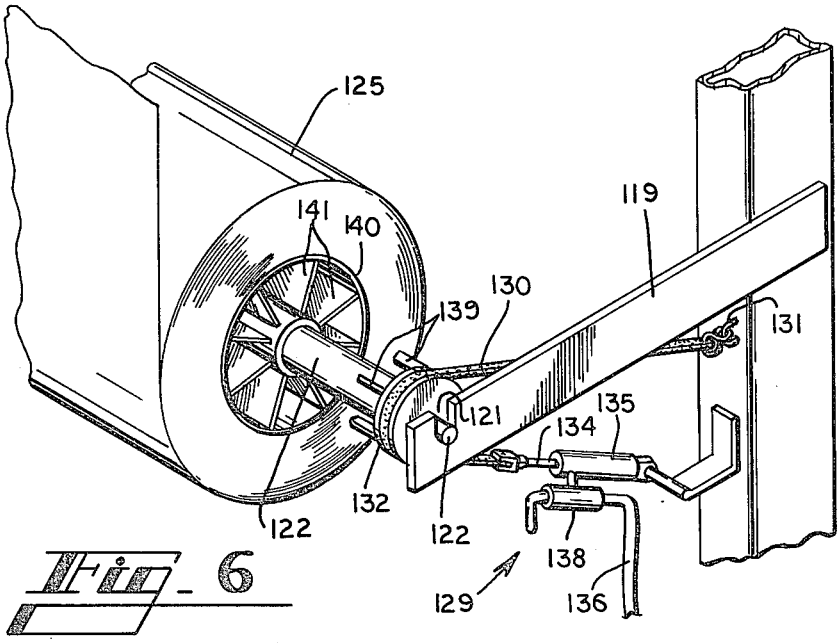
FIG. 6 is a detail illustration of a portion of a reel of tubular bag material and the brake system used to retard the rotation of the reel with the reel and core spaced away from the sheave.

A plurality of reel support brackets 118, 119 and 120 are mounted to the extensions 34 on opposite sides of the support frame 31 and upwardly facing notches 121 are formed in the brackets for receiving the ends of the axles 122. A reel 124, 125, 126 of tubular bag material is placed on each axle 122 and supported by a reel support bracket 118–120. The free end of the tubular bag material from one of the reels 124–126 is extended in an upward direction about guide bars 128 and 36 and then threaded down through the assembly. A pneumatically operated brake assembly 129 (FIG. 6) is located adjacent each reel support bracket 118–120. Each brake assembly 129 includes a belt 130 fastened at one of its ends to a stationary hook 131 and extending from the hook 131 about sheave 132 and then connected to the rod 134 of fluid actuated cylinder 135. Fluid line 136 communicates with cylinder 135 through manually actuated on-off valve 138. When the fluid pressure from line 136 pressurizes cylinder 135, tension is applied to the belt 130 and rotation of sheave 132 is inhibited. When the single acting cylinder 135 is depressurized, the belt 130 is relaxed and sheave 132 is permitted to rotate.

Sheave 132 includes a plurality of fingers 139 that extend toward the core structure 140 of reel 125. Core structure 140 slides along the axle 122 and occupies the circular space of reel 125, and core structure 140 includes a plurality of fins 141. Pins 139 extend between the fins 141, so that sheave 132 will not rotate with respect to reel 125. Thus, when tension is applied to belt 130, both sheave 132 and reel 125 are inhibited from rotating.

As illustrated in FIG. 3, vertically oriented switch lever assemblies 144 and 145 are located on opposite sides of the operators station. Each switch lever assembly 144 and 145 includes a vertical rod 146 and lower and upper horizontal hinge element 148 and 149. Each hinge element 148 and 149 is pivotally mounted to a support stanchion 34 as by means of a downwardly extending pivot pin 150 projecting into the opening of a socket 151. Thus, each lower and upper hinge element 148 and 149 is pivotable intermediate its ends. A retaining pin 154 is mounted at the end of a mounting strap 155, and the mounting strap 155 is rigidly mounted to a support stanchion 34 beneath each hinge element 148 and 149. The retaining pins 154 limit the distance through which the hinge elements 148 and 149 and the vertical rods 146 can be moved outwardly by the operator.

At least one switch support plate 156 is mounted on a reel support bracket 118–120 in the path of the distal end of a hinge element 148 or 149 for each switch lever assembly 144 and 145. A switch 158 is attached to the switch support plate 156 and is arranged so that its actuator is engaged by a hinge element 148 or 149 when the switch lever assembly 144 or 145 is moved inwardly toward the operator's station. Springs (not shown) mounted to each stanchion of 34 biases the hinge element 148 and 149 toward engagement with the actuator of each switch 158, thus biasing the vertical rods 146 of each switch lever assembly toward the operator. With this arrangement, the switches 158 will usually be engaged by a hinge element 148 or 149 until the operator moves her hand against a vertical rod 146 so as to pivot the rod outwardly away from the operator's station, whereupon the distal end of the hinge element 148 or 149 moves away from the switch 158.

Control System

Figure 8:
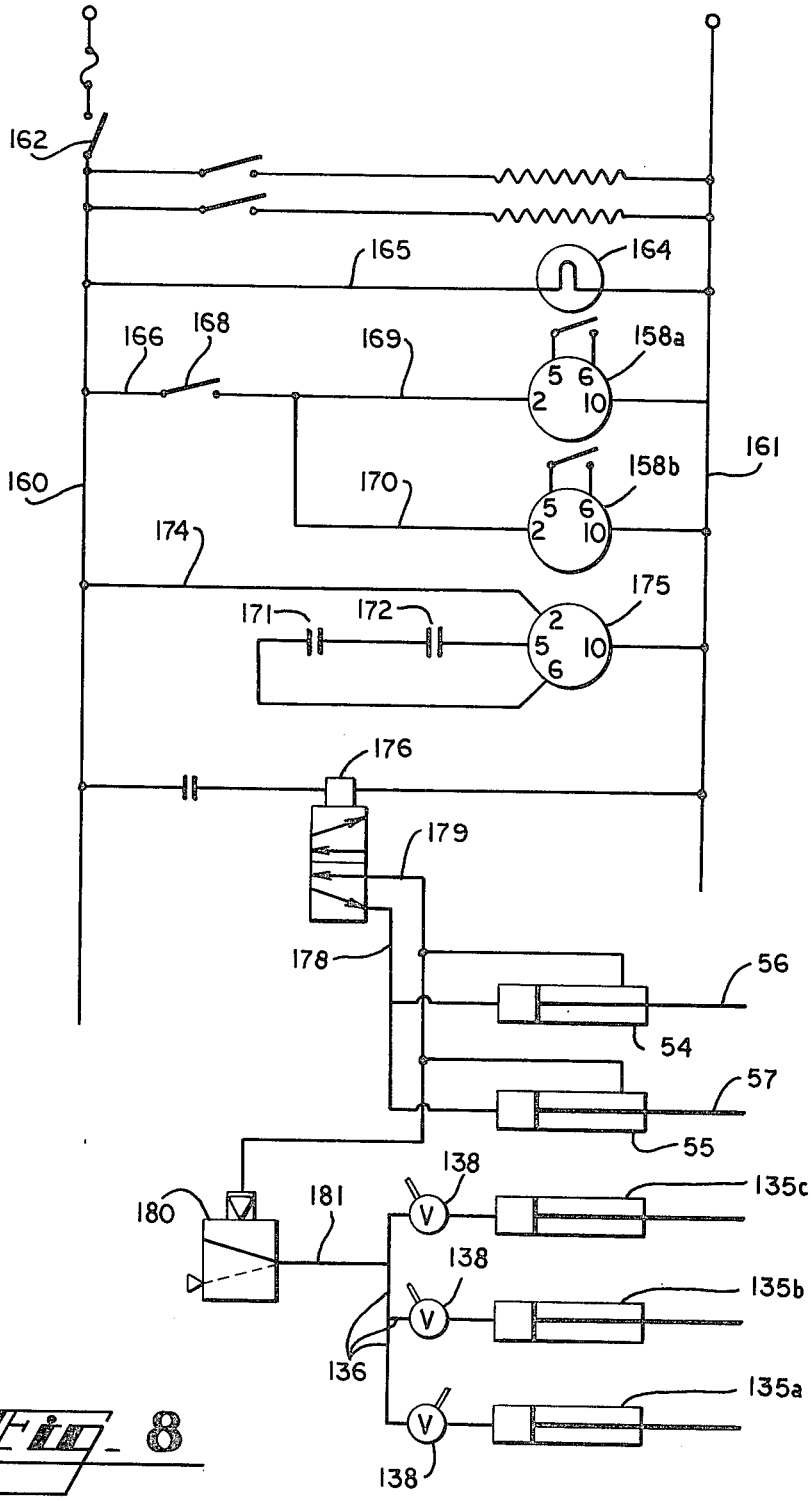
FIG. 8 is a schematic illustration of the electrical and mechanical control system for the garment bagging system.

As illustrated in FIG. 8, main on-off switch 162 connects conductor 160 to a source of power while conductor 161 leads to ground. Indicator lamp 164 is connected by means of conductor 165 between conductors 160 and 161 and indicates when the on/off switch 162 is closed. Switches 158 which are actuated by the operator upon moving the switch lever assemblies 144 and 145 are indicated as 158A and 158B in FIG. 9 and are connected in parallel in the circuit. Conductor 166 leads from conductor 160, and on/off switch connects conductor 166 to parallel conductors 169 and 170 to control switches 158A and 158B. Switches 158A and 158B are considered as start switches, and switch 158A controls time delay relay 171 while switch 158B controls time delay relay 172. Conductor 174 extends from conductor 160 to dwell time delay relay 175, and the time delay relays 171 and 172 are connected in series between contacts 5 and 6 of dwell time delay relay 175. Thus, when both the start switches 158A and 158B are actuated simultaneously or within a short time span, dwell time delay relay 175 actuates solenoid valve 176. Solenoid valve 176, when not actuated, exerts pressure through fluid conduit 178 behind the piston rods 56 and 57 of fluid actuated cylinders 54 and 55. When solenoid valve 176 is actuated, the pressure in line 178 is depleted and pressure is applied to line 179, whereupon the cylinder rods 156 and 157 are retracted, thus moving cutter assembly 42 and sealer assembly 44 toward engagement with cutter receiver assembly 43 and sealer receiver assembly 45. In the meantime, pressure to line 179 actuates valve 180, permitting fluid pressure to pass through the valve 180 to conduit 181. Conduit 181 communicates with one of the branch conduits 136 and its opened manually actuated valve 138 to a cylinder 135A, 135B or 135C. Thus, when the operator has pulled the tubular bag material down about a garment, causing the reel of bag material to rotate, and the operator actuates the switch lever assemblies 144 and 145 in close time sequence, cylinders 54 and 55 cause the tubular bag material to be cut and sealed and one of the cylinders 135 a,b or c causes the reel from which the tubular bag has been pulled to be retarded from rotating.

During normal operation of the garment bagging system, the tubular bag material 16 extends upwardly from a reel 124–126, over upper guide bar 36 and then downwardly about garment support assembly 88, but inwardly between support bars 38 and 39. The parallel rollers 98 and 99 are rotatable, as are support bars 38 and 39, so that when the operator pulls the tubular bag material downwardly, the material moves downwardly about and between the support bars 38 and 39, about the upper enlarged portion 90 of the bag opening frame, then on downwardly about the garment. The garment support assembly 88 is supported on parallel rollers 98 and 99 until the tubular bag material 16 is to be changed. The operator then pulls downwardly on the rod 15 to pull the garment support assembly 88 down between the parallel rollers 98 and 99, and between the cutter assembly 42 its cutter receiver assembly 43 and between the sealer assembly 44 and its sealer receiver assembly 45. The new bag material is then treaded down between parallel rollers 98 and 99, the garment support assembly 88 inserted in the tubular bag material, and the garment support assembly pushed back up between the parallel rollers 98 and 99. The operator is then ready to resume normal operation of the system.

While this invention has been described in specific detail with particular reference to a preferred embodiment thereof, it will be understood that variations and modifications can be effected within the spirit and scope of the invention as described hereinbefore and as defined in the appended claims.

We claim:

1. Apparatus for forming a bag about a garment or the like comprising a support frame, a pair of spaced apart, parallel horizontal support rods supported at their ends by said support frame, a garment support assembly comprising a bag opening frame, a pair of spaced apart, parallel support rollers rotatably supported at their ends by said bag opening frame, said support rollers together being of an effective combined width less than the space between said support rods, means for biasing said support rollers apart whereby the support rollers can support themselves and said garment support assembly on said support rods with the bag opening frame suspended down between said support rods and the garment support assembly can be pulled downwardly away from the support rods by forcing the support rollers toward each other, a garment support rod connected at one of its ends to said bag opening frame and normally extending downwardly from said bag opening frame when said bag opening frame is supported between said support rods, and bag material cutting and sealing means positioned below said bag opening frame at the level of said garment support rod, said bag material cutting and sealing means including means for cutting through the bag material and sealing the bag material from positions adjacent and extending away from opposite sides of said support rod, whereby a garment or the like is hung from the lower end of said garment support rod, tubular bag material is fed from a supply along its length downwardly between said support rods and about said garment support assembly and about the garment hung on the garment support rod, and the bag material cutting and sealing means seals the bag material together above the lower end portion of the garment rod and cuts across the bag material above the seal of the bag material.

2. Apparatus for forming a bag about a garment comprising a support frame, spaced support members mounted on said support frame, a garment support assembly including an upper portion which is effectively expandable from a width smaller than the space between said spaced support members to a width greater than the space between said spaced support members and movable upwardly between said spaced support members to be supported by said support members, bag material cutting and sealing means positioned below said support members for cutting and sealing across bag material, and said garment support assembly including a garment hanger rod extending downwardly therefrom from a position above to a position below said cutting and sealing means when said garment support assembly is supported by said spaced support members, whereby first the free end of the tubular garment bag material is extended downwardly between said spaced support members, then the garment support assembly is inserted into the open end of the tubular garment bag material and the upper portion of the garment support member is moved upwardly between and supported on the spaced support members, garments are placed on the lower end portion of the garment hanger, the tubular bag material is moved downwardly between the spaced support members about the garment support assembly and the garment supported thereby and the tubular bag material is cut and sealed about the hanger rod to form a bag about the garment.

3. The apparatus of claim 2 and wherein said spaced support members and the upper portion of said garment support assembly are adjustable in size with respect to each other so that the upper portion of said garment support assembly can move between said spaced support members and can support said garment support assembly from the upper surfaces of said spaced support members or be moved downwardly between said spaced support members.

4. The apparatus of claim 3 and wherein the upper portion of said garment support comprises a pair of elongated parallel rolls pivotably supported at their ends on said garment support assembly and spring means for biasing said rolls apart.

5. The apparatus of claim 2 and wherein said cutting and sealing means comprises a serrated cutting blade positioned on opposite sides of said garment hanger rod and elongated heating elements positioned on opposite sides of said garment hanger rod below said cutting blade, means for simultaneously moving said cutting blades and said heating elements into engagement with said tubular bag material, and means for holding the tubular bag material at positions above and below said cutting blades as said cutting blades cut through the tubular bag material.

6. The apparatus of claim 2 and further including reel support means for supporting a reel of tubular bag material, and means for inhibiting the rotation of a reel on the reel support means as the tubular bag material is cut and sealed.

7. The apparatus of claim 2 and wherein said cutting and sealing means comprises at least one elongated heating element which defines a series of notches formed therein so as to form the tubular bag material with a series of fused spots and intervening unfused areas.

8. In apparatus for forming a bag about a garment or the like wherein a garment support assembly includes an upper enlarged portion supported on spaced support elements and tubular bag material is moved downwardly between the spaced support elements and about the garment support assembly and a garment supported by the garment support assembly, the improvement therein of said upper enlarged portion of said garment support assembly and said spaced support elements being adjustable in size with respect to each other whereby the upper enlarged portion of the garment support assembly is movable upwardly between the spaced support elements and rests on the spaced support elements.

9. The apparatus of claim 8 and wherein said garment support assembly includes a downwardly extending garment support rod for supporting a garment therebelow, and further including cutting and sealing means movable into engagement with the tubular bag material on opposite sides of said garment support rod to close the tubular bag material over the garment and to cut the bag material above its closure.

10. Apparatus for forming a bag about a garment or the like comprising a support frame, a pair of spaced apart, parallel horizontal support rods supported at their ends by said support frame, a garment support assembly comprising a bag opening frame, a pair of spaced apart, parallel support rollers rotatably supported at their ends by said bag opening frame, said support rollers together being of an effective combined width less than the space between said support rods, means for biasing said support rollers apart whereby the support rollers can support themselves and said garment support assembly on said support rods with the bag opening frame suspended down between said support rods and the garment support assembly can be pulled downwardly away from the support rods by forcing the support rollers toward each other, a garment support rod connected at one of its ends to said bag opening frame and normally extending downwardly from said bag opening frame when said bag opening frame is supported between said support rods, bag material cutting and sealing means positioned below said bag opening frame at the level of said garment support rod, said bag material cutting and sealing means including means for cutting through the bag material and sealing the bag material from positions adjacent and extending away from opposite sides of said support rod, fluid actuated cylinder means for moving said bag material cutting and sealing means into cutting and sealing engagement with said tubular bag material, electrical control means for actuating said fluid actuated cylinder means, and manual switch activating means at opposite sides of said support frame, whereby a garment or the like is hung from the lower end of said garment support rod, tubular bag material is fed from a supply along its length downwardly between said support rods and about said garment support assembly and about the garment hung on the garment support rod, and the bag material cutting and sealing means seals the bag material together above the lower end portion of the garment rod and cuts across the bag material above the seal of the bag material.

11. Apparatus for forming a bag about a garment or the like comprising a support frame including a pair of spaced apart horizontal support members in side-by-side relationship defining a space therebetween, a garment support assembly comprising a pair of parallel support rollers together being of an effective width less than the space between the support members, means for urging said support rollers apart to an effective width greater than the space between the support members whereby said support rollers are adjustable to a size that permits the support rollers to move from beneath the support members upwardly between the support members and the support rollers are expandable when positioned above the support members to rest on and become supported by said support members, said support frame including a garment hanger rod extending therefrom for extending downwardly between said support members when said support rollers are supported by said support members, bag material cutting and sealing means positioned below said support members for cutting and sealing across bag material, whereby the free end portion of tubular garment bag material is extended downwardly between the support members, the garment support assembly is inserted into the open end of the tubular garment bag material and the support member is moved upwardly until its support rollers pass between and are supported by the support member of the support frame.

* * * * *